US010479102B2

(12) United States Patent
Sakurai et al.

(10) Patent No.: US 10,479,102 B2
(45) Date of Patent: Nov. 19, 2019

(54) METHOD OF ESTIMATING AMOUNT OF INK CONSUMED AND APPARATUS FOR ESTIMATING AMOUNT OF INK CONSUMED

(71) Applicant: SCREEN HOLDINGS CO., LTD., Kyoto (JP)

(72) Inventors: Ryoko Sakurai, Kyoto (JP); Shigenori Arizono, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/697,241

(22) Filed: Sep. 6, 2017

(65) Prior Publication Data

US 2018/0065376 A1 Mar. 8, 2018

(30) Foreign Application Priority Data

Sep. 8, 2016 (JP) ..... 2016-175150

(51) Int. Cl.
*B41J 2/175* (2006.01)

(52) U.S. Cl.
CPC .. *B41J 2/17566* (2013.01); *B41J 2002/17569* (2013.01); *B41J 2002/17589* (2013.01)

(58) Field of Classification Search
USPC ..... 347/5
See application file for complete search history.

(56) References Cited

U.S. PATENT DOCUMENTS 6,219,153 B1 * 4/2001 Kawanabe ..... G06K 15/10 347/14
7,283,258 B1 10/2007 Kuno et al.
2004/0109035 A1 * 6/2004 Otokita ..... B41J 2/17566 347/5
2014/0292867 A1 * 10/2014 Takata ..... B41J 2/04563 347/14

FOREIGN PATENT DOCUMENTS

JP 2000-071582 A 3/2000
JP 2007-265419 A 10/2007

* cited by examiner

*Primary Examiner* — Lam S Nguyen
(74) *Attorney, Agent, or Firm* — McDermott Will & Emery LLP

(57) ABSTRACT

After obtaining printing data, a user is allowed to specify regions whose amounts of ink consumed are estimated using high-resolution images, by which two regions (high-resolution estimation areas and low-resolution estimation areas) are set in a printing region. Thereafter, the amounts of ink (first amounts of ink) consumed are estimated using the high-resolution images regarding the regions set as the high-resolution estimation areas, and the amounts of ink (second amounts of ink) consumed are estimated using low-resolution images regarding the regions set as the low-resolution estimation areas. Finally, the total amount of ink consumed by printing is calculated from the first amounts of ink and the second amounts of ink.

4 Claims, 10 Drawing Sheets

| | BACKGROUND | VARIABLE | | FIRST EXAMPLE | SECOND EXAMPLE | THIRD EXAMPLE |
|---|---|---|---|---|---|---|
| C | 20 | 10 | → | 30 | 10 | 20 |
| M | 30 | 60 | → | 90 | 60 | 60 |
| Y | 45 | 23 | → | 68 | 23 | 45 |
| K | 12 | 15 | → | 27 | 15 | 15 |

| | | | |
|---|---|---|---|
| 1 | 0 | 0 | 0 |

| | | | |
|---|---|---|---|
| 0 | 1 | 0 | 1 |

METHOD OF ESTIMATING AMOUNT OF INK CONSUMED AND APPARATUS FOR ESTIMATING AMOUNT OF INK CONSUMED

BACKGROUND OF THE INVENTION

Field of the Invention

The present invention relates to a method of estimating the amount of ink consumed when an inkjet printing apparatus performs printing.

Description of Related Art

Conventionally, there is known an inkjet printing apparatus that performs printing by discharging ink onto a base material (printing paper, etc.) by heat or pressure. If the inkjet printing apparatus runs out of ink in the middle of performing printing, then desired printed matter cannot be obtained, resulting in a great waste of ink, a base material, etc. Hence, there is also developed an inkjet printing apparatus having the function of performing a process of pre-estimating the amount of ink consumed when printing is performed (hereinafter, referred to as an "amount-of-ink-consumed estimation process"). According to such an inkjet printing apparatus, when it is predicted that ink runs out, a user can refill ink in advance, and thus, the occurrence of a waste of ink, a base material, etc., is suppressed. In addition, the above-described function may also be used to pre-estimate cost required for printing.

Inventions related to an amount-of-ink-consumed estimation process such as that described above are disclosed in, for example, Japanese Laid-Open Patent Publication Nos. 2000-71582 and 2007-265419. Printing systems disclosed in Japanese Laid-Open Patent Publication Nos. 2000-71582 and 2007-265419 predict the amount of ink consumed, using preview data which is generated based on data (image data) to be printed which is subjected to a RIP process. At that time, by averaging the gradations of respective pixels of an image (low-resolution image) based on the preview data, the time required to predict the amount of ink consumed is reduced.

According to techniques disclosed in Japanese Laid-Open Patent Publication Nos. 2000-71582 and 2007-265419, an increase in the speed of an amount-of-ink-consumed estimation process is achieved. However, since the amount of ink consumed is estimated by averaging the gradations of a low-resolution image, estimation accuracy is not sufficient. As such, when an amount-of-ink-consumed estimation process is performed using a low-resolution image, an estimation value with sufficient accuracy cannot be obtained.

In view of this, in order to obtain an estimation value with sufficient accuracy, an amount-of-ink-consumed estimation process may be performed using a high-resolution image. However, when an amount-of-ink-consumed estimation process is performed using a high-resolution image, the processing time increases.

In addition, in recent years, variable printing in which different content for each page is printed in a predetermined format, for example, has been actively performed. In such variable printing, the amount of ink consumed often greatly varies from page to page and also a large number of pages are often printed. Hence, regarding an amount-of-ink-consumed estimation process, there is demand for obtaining an estimation value with sufficient accuracy without requiring a large amount of processing time.

SUMMARY OF THE INVENTION

An object of the present invention is therefore to achieve an increase in the speed of an amount-of-ink-consumed estimation process while sufficient estimation accuracy is ensured.

To attain the above-described object, the present invention has features shown below.

One aspect of the present invention is directed to a method of estimating an amount of ink consumed when an inkjet printing apparatus performs printing, the method including:

a printing data obtaining step of obtaining printing data;

a region setting step of setting at least two regions in a printing region determined based on the printing data, the two regions including a first region and a second region;

a first estimating step of calculating a first amount of ink for each ink color, the first amount of ink being an amount of ink required to print a high-resolution image created based on the printing data and corresponding to the first region;

a second estimating step of calculating a second amount of ink for each ink color, the second amount of ink being an amount of ink required to print a low-resolution image created based on the printing data and corresponding to the second region; and a total-amount-of-ink calculating step of calculating, for each ink color, a total amount of ink consumed by printing of the printing data, from the first amount of ink and the second amount of ink.

According to such a configuration, at least two regions (a first region and a second region) are set in a printing region, and the amount of ink consumed is estimated using a high-resolution image created based on printing data regarding the first region, and the amount of ink consumed is estimated using a low-resolution image created based on the printing data regarding the second region. Since the estimation value of the amount of ink consumed is calculated by thus combining estimation using a high-resolution image with estimation using a low-resolution image, by appropriately setting the two regions while the characteristics of an image are considered, an amount-of-ink-consumed estimation process can be performed at a high speed while sufficient estimation accuracy is ensured.

Another aspect of the present invention is directed to an apparatus for estimating an amount of ink consumed when an inkjet printing apparatus performs printing, the apparatus including:

a printing data obtaining unit configured to obtain printing data;

a region setting unit configured to set at least two regions in a printing region determined based on the printing data, the two regions including a first region and a second region;

a first estimating unit configured to calculate a first amount of ink for each ink color, the first amount of ink being an amount of ink required to print a high-resolution image created based on the printing data and corresponding to the first region;

a second estimating unit configured to calculate a second amount of ink for each ink color, the second amount of ink being an amount of ink required to print a low-resolution image created based on the printing data and corresponding to the second region; and a total-amount-of-ink calculating unit configured to calculate, for each ink color, a total amount of ink consumed by printing of the printing data, from the first amount of ink and the second amount of ink.

These and other objects, features, modes, and effects of the present invention will be made clear from the following detailed description of the present invention with reference to the accompanying drawings.

DETAILED DESCRIPTION OF PREFERRED EMBODIMENTS

Embodiments of the present invention will be described below with reference to the accompanying drawings. Note that in the following the "estimation of the amount of ink consumed" may be simply referred to as "estimation."

1. First Embodiment

<1.1 Overall Configuration of a Printing System>

Figure 1:
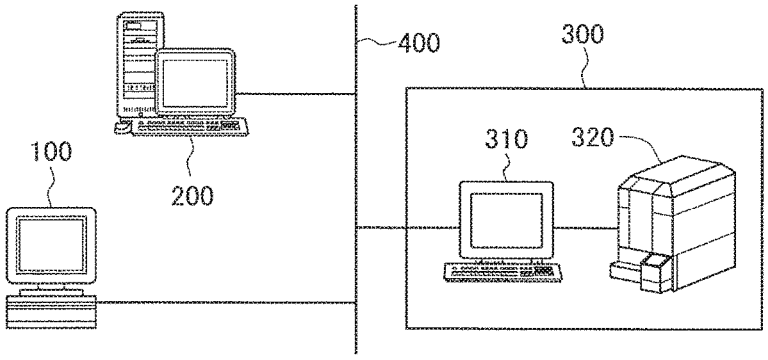
FIG. 1 is an overall configuration diagram of a printing system according to a first embodiment in the present invention.

FIG. 1 is an overall configuration diagram of a printing system according to a first embodiment in the present invention. The printing system includes a client computer 100 for performing an editing process using characters that form printed matter and a plurality of types of elements such as logos, patterns, and illustrations that form printed matter; a printing data generating apparatus 200 that generates printing data by performing data processing, such as a RIP process (rasterizing process), on submitted data (printing original data); and an inkjet printing apparatus 300 that performs color printing. The inkjet printing apparatus 300 includes a printer main body 320 and a print control apparatus 310 which is a control apparatus for the printer main body 320. The client computer 100, the printing data generating apparatus 200, and the inkjet printing apparatus 300 are connected to each other by a communication line 400 so that they can communicate with each other.

Printing by this printing system is roughly performed as follows. First, in the client computer 100, for example, page data in which a print target is described in a page description language is generated by performing editing and layout of various types of elements. The page data generated by the client computer 100 is provided, as submitted data, to the printing data generating apparatus 200. The printing data generating apparatus 200 performs data processing, such as a RIP process, on the submitted data. By this, printing data in bitmap format is generated. The printing data generated by the printing data generating apparatus 200 is sent to the inkjet printing apparatus 300. Then, the inkjet printing apparatus 300 performs printing based on the printing data.

<1.2 Configuration of the Inkjet Printing Apparatus>

Figure 2:
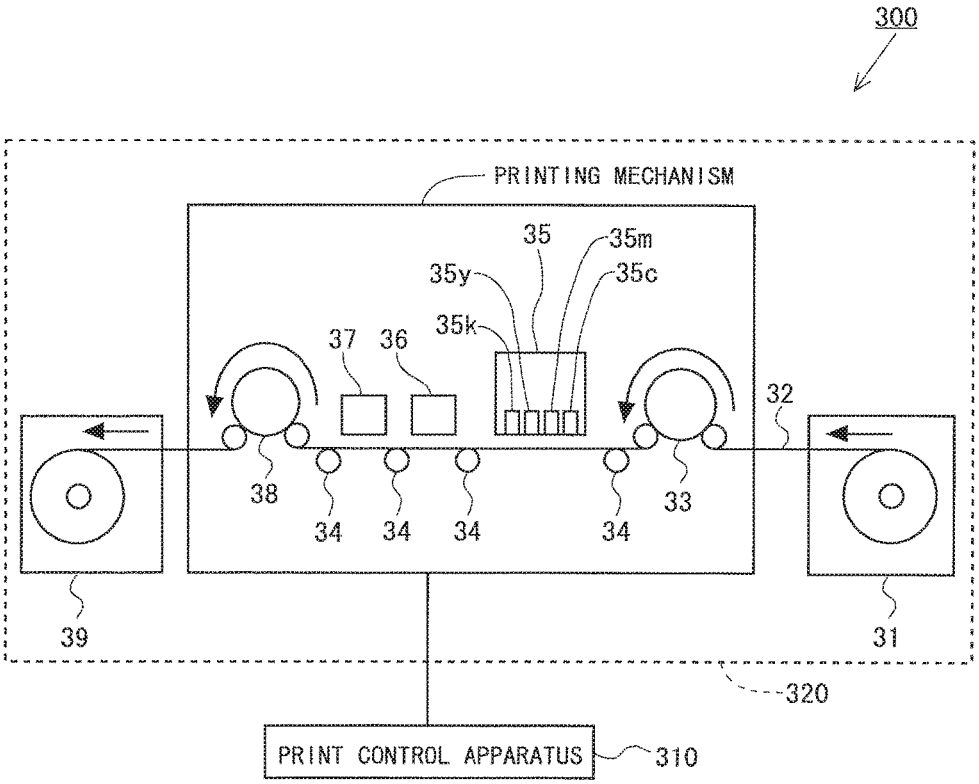
FIG. 2 is a schematic diagram showing an exemplary configuration of an inkjet printing apparatus in the first embodiment.

FIG. 2 is a schematic diagram showing an exemplary configuration of the inkjet printing apparatus 300 in the present embodiment. As described above, the inkjet printing apparatus 300 includes the printer main body 320 and the print control apparatus 310 which is a control apparatus for the printer main body 320.

The printer main body 320 includes a roll-out unit 31 that supplies a base material 32 such as printing paper; a first drive roller 33 for transporting the base material 32 into a printing mechanism; a plurality of support rollers 34 for transporting the base material 32 within the printing mechanism; a print unit 35 that performs printing by discharging ink onto the base material 32; a drying unit 36 that allows the printed base material 32 to dry; a checking unit 37 that checks the state of print on the base material 32; a second drive roller 38 for outputting the base material 32 from within the printing mechanism; and a roll-up unit 39 that rolls up the printed base material 32.

The print unit 35 includes a C inkjet head 35*c*, an M inkjet head 35*m*, a Y inkjet head 35*y*, and a K inkjet head 35*k* that discharge C (cyan), M (magenta), Y (yellow), and K (black) inks, respectively. Each of the inkjet heads 35*c*, 35*m*, 35*y*, and 35*k* has multiple nozzles that discharge ink by the drive of piezoelectric elements. Ink is discharged from each nozzle by providing a voltage of a waveform determined according to an aimed amount of ink droplets to a piezoelectric element. Note that in the printing mechanism there are also provided ink tanks (not shown) that store inks to be supplied to the respective inkjet heads 35*c*, 35*m*, 35*y*, and 35*k*.

The print control apparatus 310 controls the operation of the printer main body 320 configured in the above-described manner. When a command instructing to perform printout is provided to the print control apparatus 310, the print control apparatus 310 controls the operation of the printer main body 320 such that the base material 32 is transported from the roll-out unit 31 to the roll-up unit 39. Then, in the process of transporting the base material 32, first, print is performed by the discharge of inks from the respective inkjet heads 35*c*, 35*m*, 35*y*, and 35*k* in the print unit 35, and then the drying unit 36 allows the base material 32 to dry, and finally the checking unit 37 checks the state of print.

In addition, in the present embodiment, when a command instructing to estimate the amount of ink consumed when the inkjet printing apparatus 300 performs printing is provided to the print control apparatus 310 by an operator (user), the print control apparatus 310 estimates the amount of ink consumed as will be described later. That is, in the present embodiment, an apparatus for estimating an amount of ink consumed is implemented by the print control apparatus 310.

Note that the inkjet printing apparatus 300 in the present embodiment is an inkjet printing apparatus capable of performing so-called full-color variable printing. Although the inkjet printing apparatus 300 performs printing using water-based inks, the present invention can also be applied to the estimation of the amount of ink consumed in an inkjet printing apparatus that performs printing using inks (e.g., UV inks) other than water-based inks.

Figure 3:
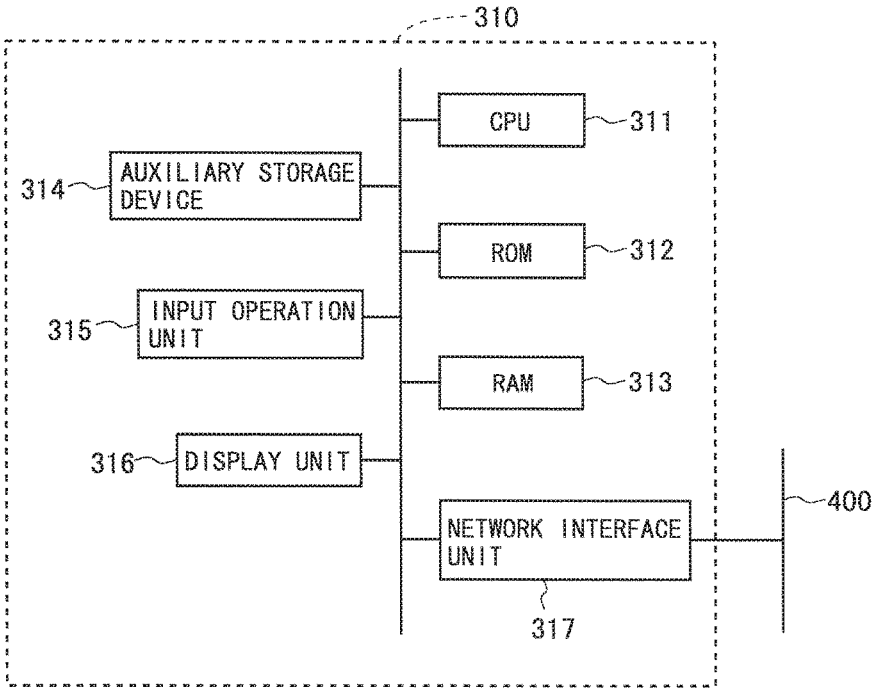
FIG. 3 is a hardware configuration diagram of a print control apparatus in the first embodiment.

FIG. 3 is a hardware configuration diagram of the print control apparatus 310 in the present embodiment. The print control apparatus 310 includes a CPU 311, a ROM 312, a RAM 313, an auxiliary storage device 314, an input operation unit 315 such as a keyboard, a display unit 316, and a network interface unit 317. Printing data which is sent from the printing data generating apparatus 200 via the communication line 400 is inputted into the print control apparatus 310 through the network interface unit 317. A program for performing an amount-of-ink-consumed estimation process (hereinafter, referred to as an "amount-of-ink-consumed estimation program") is stored in the auxiliary storage device 314. When an instruction to perform an amount-of-ink-consumed estimation process is provided, the amount-of-ink-consumed estimation program is read into the RAM 313 from the auxiliary storage device 314, and the CPU 311 executes the amount-of-ink-consumed estimation program read into the RAM 313, by which estimation of the amount of ink consumed is performed.

Figure 4:
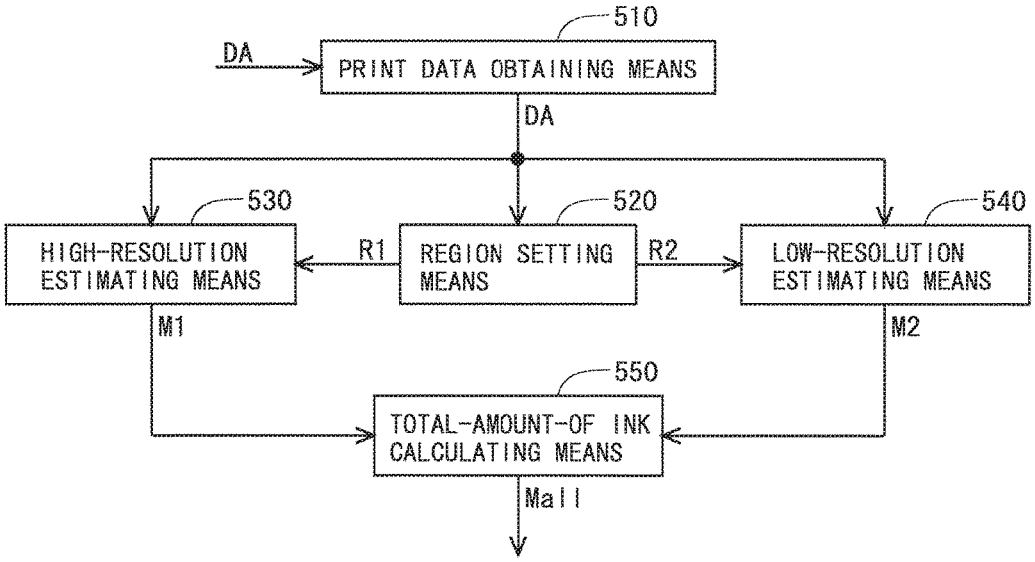
FIG. 4 is a functional block diagram showing the configurations of functions implemented by the print control apparatus in the first embodiment.

FIG. 4 is a functional block diagram showing the configurations of functions implemented by the print control apparatus 310 by executing the amount-of-ink-consumed estimation program. As shown in FIG. 4, the print control apparatus 310 is functionally provided with printing data obtaining means 510, region setting means 520, high-resolution estimating means 530, low-resolution estimating means 540, and total-amount-of-ink calculating means 550.

The printing data obtaining means 510 obtains printing data (i.e., data obtained after performing a rasterizing process on submitted data such as page data) DA which is sent from the printing data generating apparatus 200. In the present embodiment, the printing data DA includes background data and variable data. The background data is data common for all pages. The variable data is data with different content for each page.

The region setting means 520 sets two regions in a printing region determined based on the printing data DA. Specifically, the region setting means 520 sets, for each of the background data and the variable data, a region for which estimation is performed using a high-resolution image (hereinafter, referred to as a "high-resolution estimation area") R1 and a region for which estimation is performed using a low-resolution image (hereinafter, referred to as a "low-resolution estimation area") R2. Note that a first region is implemented by the high-resolution estimation area R1 and a second region is estimated by the low-resolution estimation area R2.

The high-resolution estimating means 530 estimates the amount of ink consumed in a region that is set as a high-resolution estimation area R1 by the region setting means 520. In the present embodiment, the high-resolution estimating means 530 estimates the amount of ink consumed in a region set as a high-resolution estimation area R1 for background data, using a high-resolution image created based on the background data, and further estimates the amount of ink consumed in a region set as a high-resolution estimation area R1 for variable data, using a high-resolution image created based on the variable data. Note that the amount of ink consumed which is estimated by the high-resolution estimating means 530 is referred to as a "first amount of ink" for convenience sake. The first amount of ink is provided with reference character M1.

The low-resolution estimating means 540 estimates the amount of ink consumed in a region that is set as a low-resolution estimation area R2 by the region setting means 520. In the present embodiment, the low-resolution estimating means 540 estimates the amount of ink consumed in a region set as a low-resolution estimation area R2 for background data, using a low-resolution image created based on the background data, and further estimates the amount of ink consumed in a region set as a low-resolution estimation area R2 for variable data, using a low-resolution image created based on the variable data. Note that the amount of ink consumed which is estimated by the low-resolution estimating means 540 is referred to as a "second amount of ink" for convenience sake. The second amount of ink is provided with reference character M2.

The total-amount-of-ink calculating means 550 calculates, from the first amount of ink M1 and the second amount of ink M2, a total amount of ink Mall consumed when the printing data DA sent from the printing data generating apparatus 200 is printed.

Meanwhile, the inkjet printing apparatus 300 according to the present embodiment uses inks of four colors (C, M, Y, and K). Hence, a first amount of ink M1, a second amount of ink M2, and a total amount of ink Mall are estimated for each ink color. That is, the estimation value of the amount of ink consumed is obtained for each ink color.

Note that, in the present embodiment, a first estimating unit is implemented by the high-resolution estimating means 530 and a second estimating unit is implemented by the low-resolution estimating means 540.

<1.3 Amount-of-Ink-Consumed Estimation Process>

<1.3.1 Overview>

An amount-of-ink-consumed estimation process in the present embodiment will be described below. Printing data DA includes, as described above, background data and variable data. A high-resolution estimation area R1 and a low-resolution estimation area R2 are set for each of the background data and variable data. In the present embodiment, these regions are set by a user (operator) specifying a region on a screen as will be described later. Then, for each of the background data and variable data, a high-resolution image is used for estimation regarding a region set as the high-resolution estimation area R1, and a low-resolution image is used for estimation regarding a region set as the low-resolution estimation area R2. By thus combining estimation using a high-resolution image with estimation using a low-resolution image, a total amount of ink Mall consumed when the printing data DA is printed is estimated.

Figure 5:
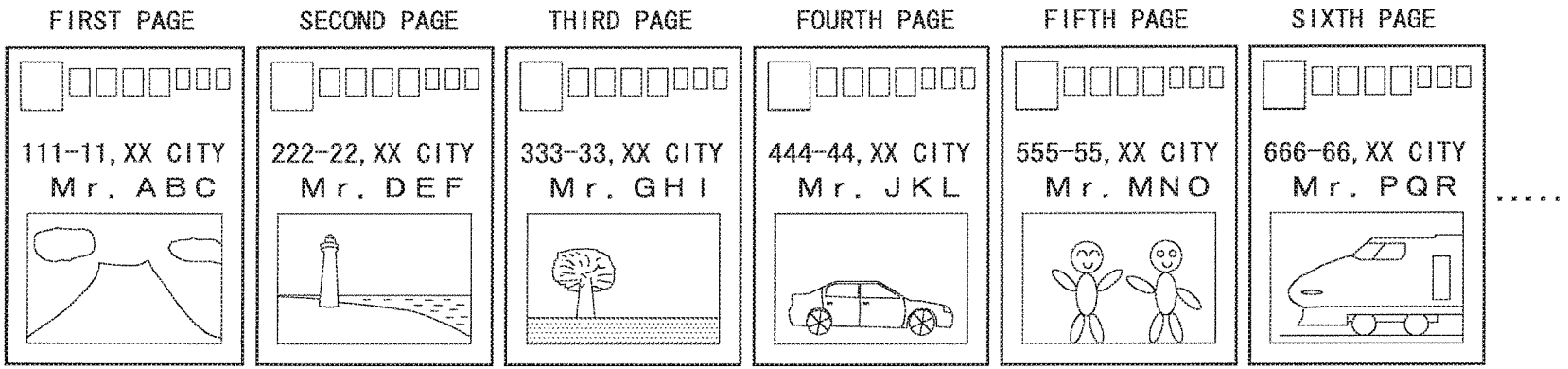
FIG. 5 is a schematic diagram showing an example of printing data in the first embodiment.
Figure 6:
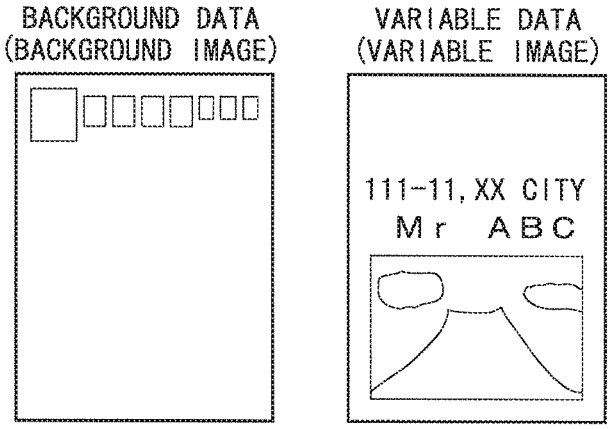
FIG. 6 is a diagram for describing a configuration of data for one page in the first embodiment.

Note that, in the following, description is made of an example case in which data such as that schematically shown in FIG. 5 is sent as printing data DA from the printing data generating apparatus 200 to the print control apparatus 310. The printing data DA shown in FIG. 5 includes a plurality of pages, and each page includes background data (background image) and variable data (variable image). More specifically, data of each page includes, as schematically shown in FIG. 6, background data (background image) representing boxes for a postal code; and variable data (variable image) including characters representing an address and an image such as a landscape.

<1.3.2 Processing Procedure>

Figure 7:
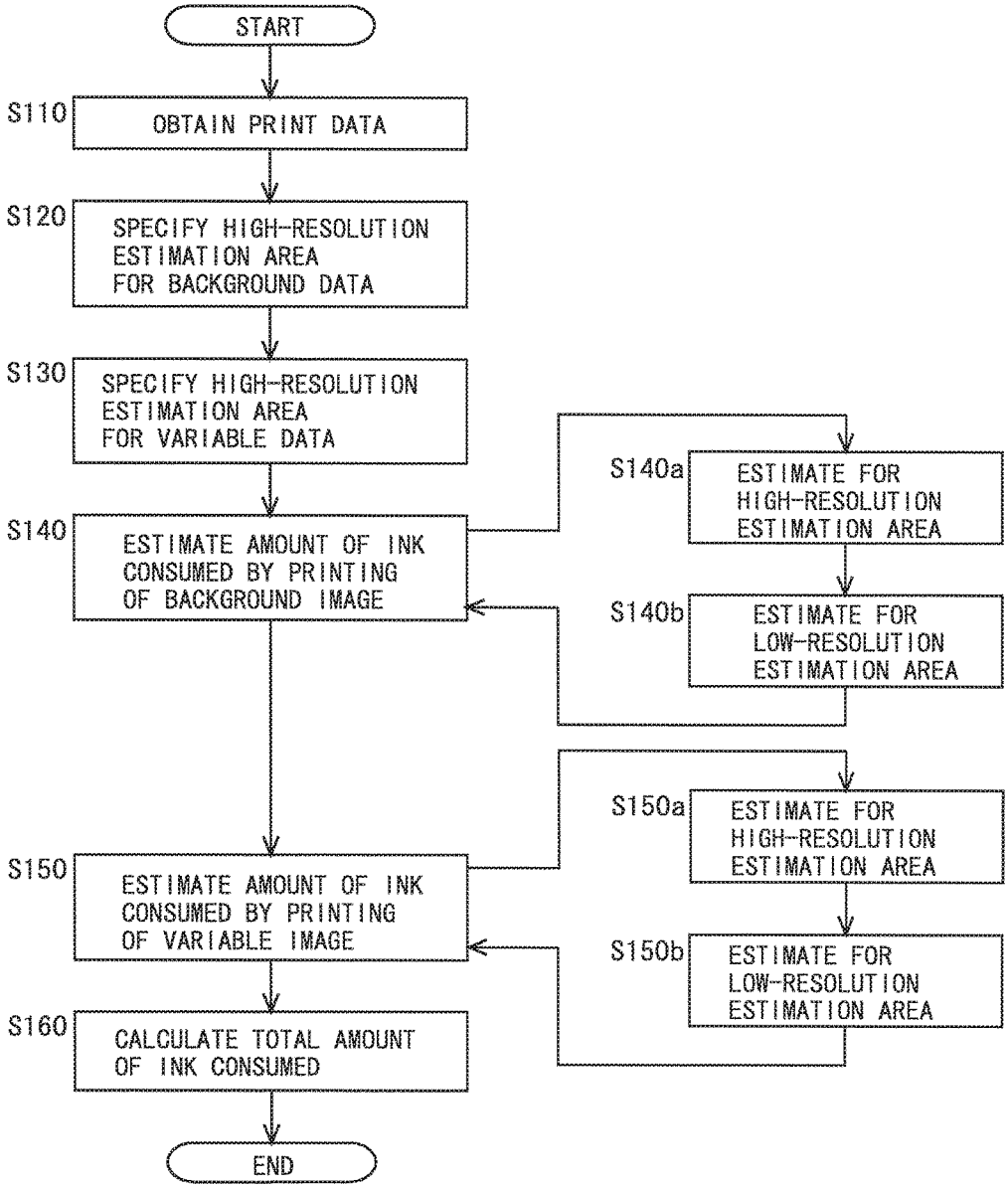
FIG. 7 is a flowchart showing a procedure of an amount-of-ink-consumed estimation process in the first embodiment.

FIG. 7 is a flowchart showing a procedure of an amount-of-ink-consumed estimation process in the present embodiment. Note that the amount-of-ink-consumed estimation process is performed by the print control apparatus 310. Note, however, that the present invention can also be applied to a case in which the amount-of-ink-consumed estimation process is performed by an apparatus other than the print control apparatus 310.

After the amount-of-ink-consumed estimation process starts, first, printing data DA is obtained (step S110). Specifically, the print control apparatus 310 receives printing data DA from the printing data generating apparatus 200.

Figure 8:
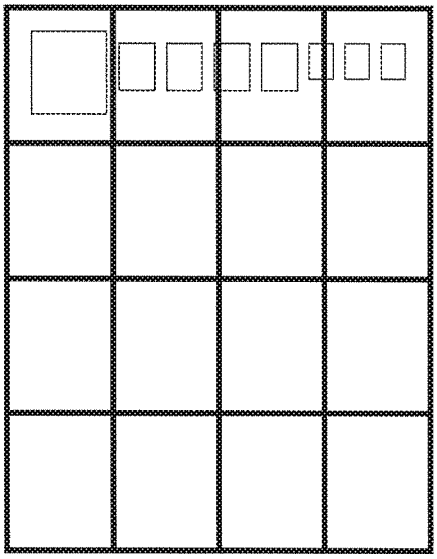
FIG. 8 is a diagram for describing specification of a high-resolution estimation area for background data in the first embodiment.
Figure 9:
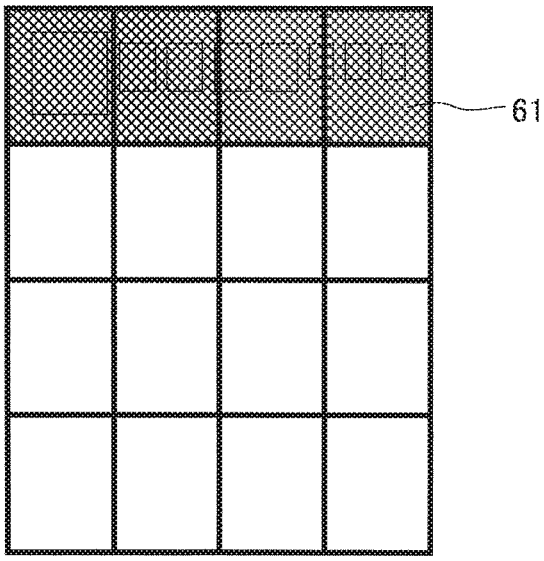
FIG. 9 is a diagram for describing specification of a high-resolution estimation area for background data in the first embodiment.

Then, a user (operator) specifies a high-resolution estimation area R1 for background data (step S120). Specifically, the display unit 316 of the print control apparatus 310 displays, for example, as shown in FIG. 8, a screen (region specification screen) on which only a background image of a representative page among a plurality of pages included in the printing data DA is divided into predetermined rectangular regions (in the example shown in FIG. 8, 4×4 rectangular regions) and shown. With such a region specification screen displayed, the user specifies rectangular regions that are set as a high-resolution estimation area R1, as shown in FIG. 9, for example. Note that, regarding FIG. 9, shaded regions denoted by reference character 61 are rectangular regions specified by the user. A group of the rectangular regions thus specified by the user is set as a high-resolution estimation area R1. In addition, for the background data, a group of rectangular regions that are not specified by the user among the entire printing region is set as a low-resolution estimation area R2. In the above-described manner, the high-resolution estimation area R1 and the low-resolution estimation area R2 are set for the background data.

Figure 10:
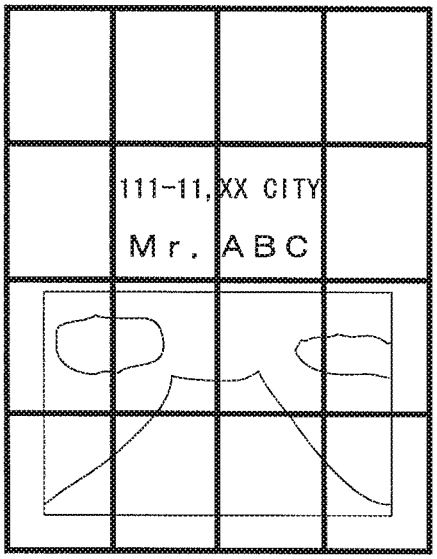
FIG. 10 is a diagram for describing specification of a high-resolution estimation area for variable data in the first embodiment.
Figure 11:
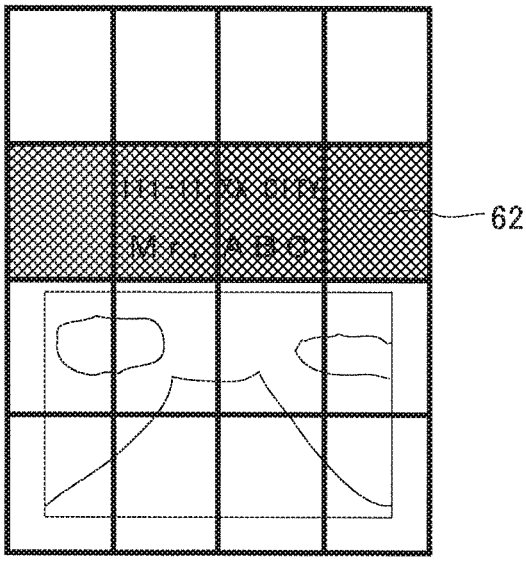
FIG. 11 is a diagram for describing specification of a high-resolution estimation area for variable data in the first embodiment.

Then, the user specifies a high-resolution estimation area R1 for variable data (step S130). Specifically, the display unit 316 of the print control apparatus 310 displays, for example, as shown in FIG. 10, a screen (region specification screen) on which only a variable image of a representative page among the plurality of pages included in the printing data DA is divided into predetermined rectangular regions (in the example shown in FIG. 10, 4×4 rectangular regions) and shown. With such a region specification screen displayed, the user specifies rectangular regions that are set as a high-resolution estimation area R1, as shown in FIG. 11, for example. Note that, regarding FIG. 11, shaded regions denoted by reference character 62 are rectangular regions specified by the user. A group of the rectangular regions thus specified by the user is set as a high-resolution estimation area R1. In addition, for the variable data, a group of rectangular regions that are not specified by the user among the entire printing region is set as a low-resolution estimation area R2. In the above-described manner, the high-resolution estimation area R1 and the low-resolution estimation area R2 are set for the variable data.

Then, the amount of ink consumed by printing of the background image is estimated (step S140). At this step S140, the amount of ink consumed only for the representative page among the plurality of pages included in the printing data DA is estimated. At that time, estimation is performed using a high-resolution image created based on the background data regarding the regions set as the high-resolution estimation area R1 by the process at step S120, and estimation is performed using a low-resolution image created based on the background data regarding the regions set as the low-resolution estimation area R2 by the process at step S120. That is, step S140 specifically includes step S140*a* at which estimation for the high-resolution estimation area R1 is performed; and step S140*b* at which estimation for the low-resolution estimation area R2 is performed. At step S140*a* a first amount of ink M1 for the background data is estimated, and at step S140*b* a second amount of ink M2 for the background data is estimated. In the above-described manner, at step S140, the amount of ink required to print the background image is estimated.

Then, the amount of ink consumed by printing of variable images is estimated (step S150). At this step S150, unlike the above-described step S140, a total of the amounts of ink consumed for the respective plurality of pages included in the printing data DA is estimated. At that time, estimation is performed using a high-resolution image created based on variable data regarding the regions set as the high-resolution estimation area R1 by the process at step S130, and estimation is performed using a low-resolution image created based on the variable data regarding the regions set as the low-resolution estimation area R2 by the process at step S130. That is, step S150 specifically includes step S150*a* at which estimation for the high-resolution estimation area R1 is performed; and step S150*b* at which estimation for the low-resolution estimation area R2 is performed. At step S150*a* a first amount of ink M1 for variable data is estimated, and at step S150*b* a second amount of ink M2 for the variable data is estimated. In the above-described manner, at step S150, the amount of ink required to print the variable images is estimated.

Meanwhile, at step S140*b* and step S150*b*, estimation using a low-resolution image is performed. In order to implement this, in the print control apparatus 310, after obtaining printing data DA, a low-resolution image is generated by performing downsampling (a reduction in the number of pixels) on the printing data DA at appropriate timing. At step S140*a* and step S150*a*, estimation using a high-resolution image is performed. Regarding this, the printing data DA obtained at step S110 may be used as it is as a high-resolution image, or an image obtained by performing downsampling on the printing data DA at a higher sampling frequency than that used when a low-resolution image is created may be used as a high-resolution image.

Finally, a total amount of ink Mall consumed by printing of the printing data DA is calculated based on the estimation result obtained at step S140 and the estimation result obtained at step S150 (step S160). Specifically, the total amount of ink Mall is calculated by the following equation:

$$\text{Mall}=(BM1+BM2)\times NP+(VM1+VM2)$$

where BM1 represents the first amount of ink for the background data (the estimation value obtained at step S140*a*), BM2 represents the second amount of ink for the background data (the estimation value obtained at step S140*b*), VM1 represents the first amount of ink for the variable data (the estimation value obtained at step S150*a*), VM2 represents the second amount of ink for the variable data (the estimation value obtained at step S150*b*), and NP represents the number of pages included in the printing data DA.

By calculating the total amount of ink Mall consumed by printing of the printing data DA in the above-described manner, the amount-of-ink-consumed estimation process ends. Note that when the amounts of ink (the first amount of ink M1, the second amount of ink M2, and the total amount of ink Mall) are estimated, a computation process is skipped for portions that do not have valid data, by which an increase in the speed of the amount-of-ink-consumed estimation process can be achieved. This also applies to a second and third embodiment which will be described later.

Meanwhile, as described above, the amount of ink consumed is estimated for each ink color. Therefore, for example, at the above-described step S140*a*, the amount of ink consumed by printing of a background image in a high-resolution estimation area R1 is estimated for each of the four colors (C, M, Y, and K).

Note that, in the present embodiment, a printing data obtaining step is implemented by the above-described step S110, a region setting step is implemented by the above-described steps S120 and S130, a first estimating step is implemented by the above-described steps S140*a* and S150*a*, a second estimating step is implemented by the above-described steps S140*b* and S150*b*, and a total-amount-of-ink calculating step is implemented by the above-described step S160.

<1.3.3 Process for a Portion in which a Background Image and a Variable Image Overlap>

Meanwhile, depending on printing data DA, there may be a portion (overlapping region) in which a background image and a variable image overlap (in other words, there may be an overlapping portion between a region having data valid as background data and a region having data valid as variable data). What process is to be performed when the amount of ink consumed is estimated for such a case will be described with reference to FIG. 12. Note that although here three examples are described, a specific process is not limited to those three examples. Note also that a plurality of processes such as processes of the following three examples may be prepared and the user may be allowed to select a process to be actually performed.

1.3.3.1 First Example

A first example will be described. A process of this example gives priority to the computation speed over the accuracy of an estimation value. Specifically, the estimation value of the amount of ink consumed in an overlapping region is obtained by simply adding, for each ink color, the amount of ink predicted to be consumed by printing of a background image to the amount of ink predicted to be consumed by printing of a variable image.

As described above, in the first example, when there is a portion (overlapping region) in which a background image and a variable image overlap, the estimation value of the amount of ink required to print the overlapping region is equal to the total value of the estimation value of the amount of ink required to perform printing based on background data in the overlapping region and the estimation value of the amount of ink required to perform printing based on variable data in the overlapping region.

1.3.3.2 Second Example

A second example will be described. A process of this example gives priority to the accuracy of an estimation value over the computation speed. Specifically, first, the same process as a merging process which is performed upon actual printing (a process of merging background data with variable data to generate data with no distinction between the background data and the variable data) is performed. At that time, in order to prevent the color of the background data and the color of the variable data from getting mixed up, a process of converting background data in an overlapping region into data corresponding to no color (a process called "knockout", etc.) is performed. Then, estimation is performed using data obtained by such a process. By this, consequently, the estimation value of the amount of ink predicted to be consumed by printing of a variable image is the estimation value of the amount of ink consumed in the overlapping region.

As described above, in the second example, when there is a portion (overlapping region) in which a background image and a variable image overlap, the estimation value of the amount of ink required to print the overlapping region is equal to the estimation value of the amount of ink required to perform printing based on variable data in the overlapping region.

1.3.3.3 Third Example

A third example will be described. As with the process of the second example, a process of this example gives priority to the accuracy of an estimation value over the computation speed. In this example, too, first, the same process as a merging process which is performed upon actual printing is performed. At that time, unlike the second example, a process (a process called "max merging", etc.) is performed in which the larger one (maximum value) of the value of background data and the value of variable data for each pixel and each color is used as the value of merged data. Then, estimation is performed using data obtained by such a process. By this, consequently, for each pixel, the larger one of the estimation value of the amount of ink predicted to be consumed by printing of a background image and the estimation value of the amount of ink predicted to be consumed by printing of a variable image is the estimation value of the amount of ink consumed in an overlapping region.

As described above, in the third example, when there is a portion (overlapping region) in which a background image and a variable image overlap, the estimation value of the amount of ink required to print the overlapping region is equal to the larger one of the estimation value of the amount of ink required to perform printing based on background data in the overlapping region and the estimation value of the amount of ink required to perform printing based on variable data in the overlapping region.

1.3.3.4 Specific Examples

Figures 12, 13:
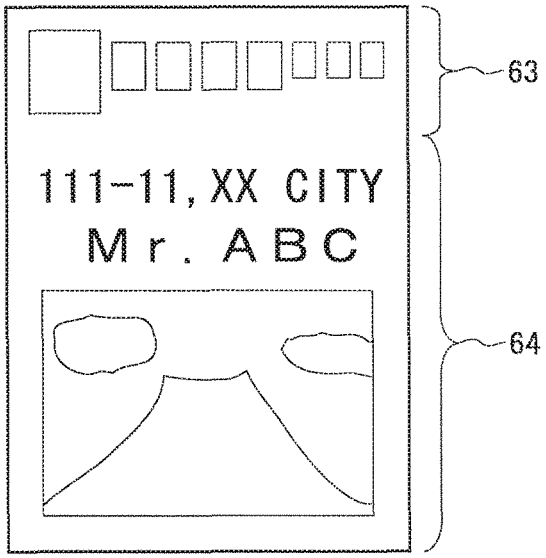
FIG. 12 is a diagram for describing a process performed when there is a portion (overlapping region) in which a background image and a variable image overlap in the first embodiment.
FIG. 13 is a diagram for describing an overview of a second embodiment in the present invention.

For example, it is assumed that for a given pixel, the amounts of ink predicted to be consumed by printing of a background image are "(C, M, Y, K)=(20, 30, 45, 12)" and the amounts of ink predicted to be consumed by printing of a variable image are "(C, M, Y, K)=(10, 60, 23, 15)". In this case, as shown in FIG. 12, in the first example, the estimation values for the pixel are "(C, M, Y, K)=(30, 90, 68, 27)"; in the second example, the estimation values for the pixel are "(C, M, Y, K)=(10, 60, 23, 15)"; and in the third example, the estimation values for the pixel are "(C, M, Y, K)=(20, 60, 45, 15)."

<1.4 Effect>

According to the present embodiment, for each of background data and variable data, the user can set two regions (a high-resolution estimation area R1 and a low-resolution estimation area R2) in a printing region. Then, the amount of ink consumed in a region set as the high-resolution estimation area R1 is estimated using a high-resolution image created based on printing data DA, and the amount of ink consumed in a region set as the low-resolution estimation area R2 is estimated using a low-resolution image created based on the printing data DA. As such, the estimation value of the amount of ink consumed can be calculated by combining estimation using a high-resolution image with estimation using a low-resolution image, while the characteristics of an image are considered. By this, while sufficient estimation accuracy is ensured by performing estimation using a high-resolution image regarding a region that causes a large error if estimation is performed using a low-resolution image, high-speed estimation can be performed by performing estimation using a low-resolution image regarding other regions. As described above, according to the present embodiment, an increase in the speed of an amount-of-ink-consumed estimation process is achieved while sufficient estimation accuracy is ensured. Accordingly, even when variable printing is performed, the estimation value of the amount of ink consumed can be obtained with sufficient accuracy without requiring a large amount of processing time.

2. Second Embodiment

<2.1 Overview>

In the first embodiment, two regions (a high-resolution estimation area R1 and a low-resolution estimation area R2) are set based on a user operation (an operation of specifying rectangular regions on a screen). However, such an operation is often a great burden to the user. Hence, in the present embodiment, the above-described two regions are set without through a user operation. More specifically, a region having background data is set as a high-resolution estimation area R1, and a region having variable data is set as a low-resolution estimation area R2.

Note that an overall configuration of the printing system and a configuration of the inkjet printing apparatus 300 in the present embodiment are the same as those of the first embodiment and thus description thereof is omitted (see FIGS. 1 to 4). Note, however, that regarding the configurations of functions implemented by the print control apparatus 310 (see FIG. 4), in the present embodiment, the region setting means 520 sets a region having data valid as background data as a high-resolution estimation area R1, and sets a region having data valid as variable data as a low-resolution estimation area R2. Accordingly, the high-resolution estimating means 530 estimates, only for background data, the amount of ink consumed in a region set as a high-resolution estimation area R1, and the low-resolution estimating means 540 estimates, only for variable data, the amount of ink consumed in a region set as a low-resolution estimation area R2.

Here, it is assumed that data such as that shown in FIG. 5 is sent as printing data DA from the printing data generating apparatus 200 to the print control apparatus 310, and it is assumed that a region denoted by reference character 63 in FIG. 13 only has background data, and a region denoted by reference character 64 in FIG. 13 only has variable data.

<2.2 Procedure of an Amount-of-Ink-Consumed Estimation Process>

Figure 14:
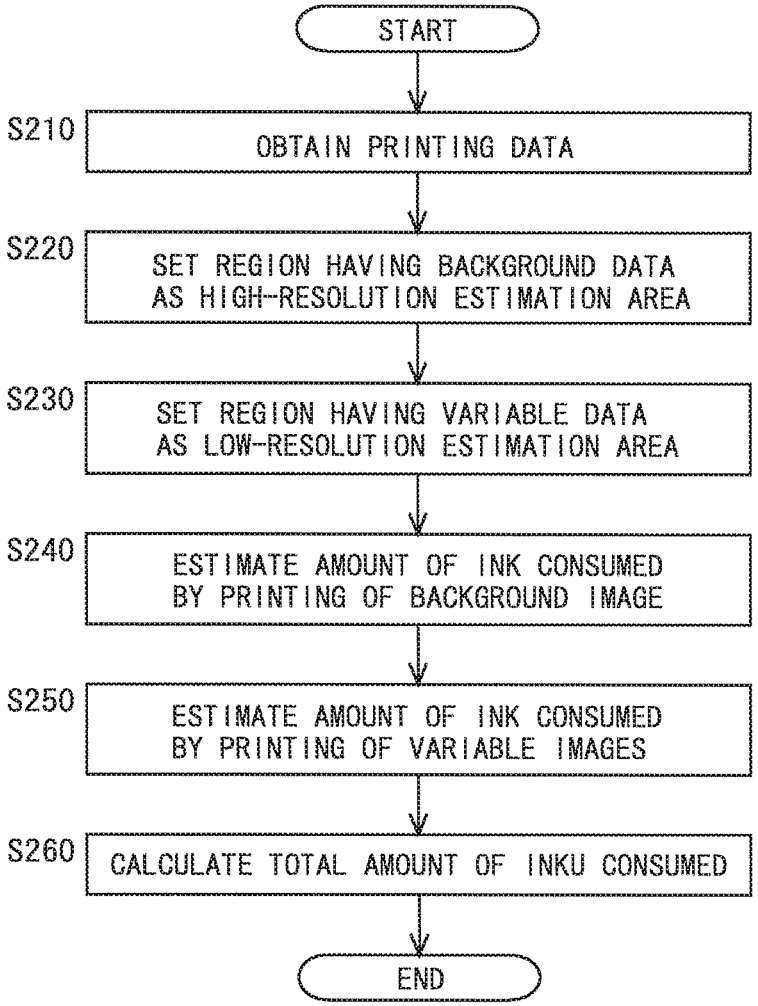
FIG. 14 is a flowchart showing a procedure of an amount-of-ink-consumed estimation process in the second embodiment.

FIG. 14 is a flowchart showing a procedure of an amount-of-ink-consumed estimation process in the present embodiment. After the amount-of-ink-consumed estimation process starts, first, printing data DA is obtained (step S210).

Then, based on the printing data DA obtained at step S210, a region having data valid as background data is set as a high-resolution estimation area R1 (step S220). In the example shown in FIG. 13, background data is present only in the region denoted by reference character 63 and thus the region denoted by reference character 63 is set as a high-resolution estimation area R1.

Then, based on the printing data DA obtained at step S210, a region having data valid as variable data is set as a low-resolution estimation area R2 (step S230). In the example shown in FIG. 13, variable data is present only in the region denoted by reference character 64 and thus the region denoted by reference character 64 is set as a low-resolution estimation area R2.

In the above-described manner, two regions (a high-resolution estimation area R1 and a low-resolution estimation area R2) are set without through a user operation.

Then, the amount of ink consumed by printing of a background image is estimated (step S240). At this step S240, the amount of ink consumed only for a representative page among a plurality of pages included in the printing data DA is estimated. At that time, only for the region set as the high-resolution estimation area R1 by the process at step S220, estimation using a high-resolution image created based on the background data is performed. In the above-described manner, at step S240, the amount of ink required to print the high-resolution image created based on the background data for one page is calculated as a first amount of ink M1.

Then, the amount of ink consumed by printing of variable images is estimated (step S250). At this step S250, unlike the above-described step S240, a total of the amounts of ink consumed for the respective plurality of pages included in the printing data DA is estimated. At that time, only for the region set as the low-resolution estimation area R2 by the process at step S230, estimation using a low-resolution image created based on variable data is performed. In the above-described manner, at step S250, the sum total of the amounts of ink for all pages that are required to print the low-resolution images created based on the variable data for the respective pages is calculated as a second amount of ink M2.

Finally, a total amount of ink Mall consumed by printing of the printing data DA is calculated based on the estimation result obtained at step S240 and the estimation result obtained at step S250 (step S260). Specifically, the total amount of ink Mall is calculated by the following equation:

$$\text{Mall}=M1\times NP+M2$$

where M1 represents the first amount of ink (the estimation value obtained at step S240), M2 represents the second amount of ink (the estimation value obtained at step S250), and NP represents the number of pages included in the printing data DA.

By calculating the total amount of ink Mall consumed by printing of the printing data DA in the above-described manner, the amount-of-ink-consumed estimation process ends.

Note that although here description is made based on the premise that there is no portion (overlapping region) in which a background image and a variable image overlap (see FIG. 13), when there is an overlapping region, the same processes as those of the first embodiment (the processes of the above-described first to third examples) may be performed.

<2.3 Effects>

According to the present embodiment, without through a user operation, a region having background data is set as a high-resolution estimation area R1, and a region having variable data is set as a low-resolution estimation area R2. Then, regarding the amount of ink consumed in the region set as the high-resolution estimation areas R1, estimation is performed using a high-resolution image created based on background data for one page, and regarding the amount of ink consumed in the region set as the low-resolution estimation area R2, estimation is performed using a low-resolution image created based on variable data for each page. In this manner, the amount of ink consumed by performing printing based on background data which is data common for all pages is estimated by performing a computation process only once at a high resolution, and the amount of ink consumed by performing printing based on variable data which is data different for each page is estimated by performing a computation process for each page at a low resolution. By this, even when a large number of pages (e.g., several tens of thousands of pages) are printed by variable printing, the estimation value of the amount of ink consumed can be obtained beforehand with sufficient accuracy without requiring a large amount of processing time. In addition, no operational burden is placed on the user.

3. Third Embodiment

<3.1 Overview>

As described above, it is often a great burden for a user to perform an operation for setting regions. Hence, in the second embodiment, regardless of the content of printing data DA, a region having background data is set as a high-resolution estimation area R1, and a region having variable data is set as a low-resolution estimation area R2. However, background data may include data (e.g., tint data, illustration data, or image data) that only causes a slight error even if estimation is performed using a low-resolution image, and variable data may include data (e.g., text data or thin-line data) that causes a large error when estimation is performed using a low-resolution image. In view of this, in the present embodiment, regardless of whether each region has background data or variable data, two regions (a high-resolution estimation area R1 and a low-resolution estimation area R2) are set based on the type of object included in data of each pixel.

Note that an overall configuration of the printing system and a configuration of the inkjet printing apparatus 300 in the present embodiment are the same as those of the first embodiment and thus description thereof is omitted (see FIGS. 1 to 4). Note, however, that regarding the configurations of functions implemented by the print control apparatus 310 (see FIG. 4), in the present embodiment, the region setting means 520 sets a high-resolution estimation area R1 and a low-resolution estimation area R2 based on mask data representing correspondences between pixels and object types, so that the regions are set depending on the object type. In addition, the printing data obtaining means 510 receives mask data which will be described later, in addition to printing data DA from the printing data generating apparatus 200.

<3.2 Procedure of an Amount-of-Ink-Consumed Estimation Process>

Figures 15, 16, 17:
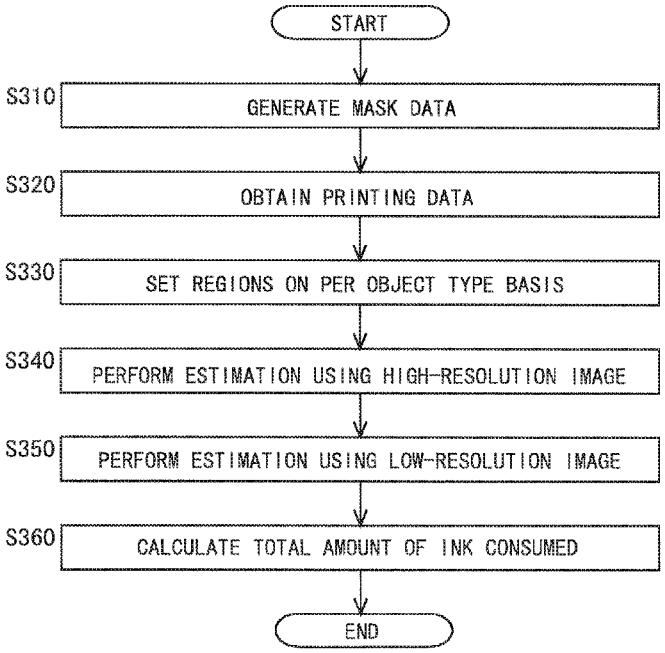
FIG. 15 is a flowchart showing a procedure of an amount-of-ink-consumed estimation process in a third embodiment in the present invention.
FIG. 16 is a diagram for describing mask data in the third embodiment.
FIG. 17 is a diagram for describing mask data in the third embodiment.

FIG. 15 is a flowchart showing a procedure of an amount-of-ink-consumed estimation process in the present embodiment. In the present embodiment, first, mask data by which an object type can be identified is generated (step S310). For example, the mask data is generated with printing data DA when the printing data generating apparatus 200 performs a RIP process on submitted data. The mask data is data prepared for each page, and data for one pixel is 4-bit data such as that shown in FIG. 16 in the present embodiment. Those four bits are used as follows. When an object is not present at all in a target pixel portion, the value of the first bit is "1." When text data or thin-line data is present in the target pixel portion, the value of the second bit is "1." When tint or illustration data is present in the target pixel portion, the value of the third bit is "1." When image data is present in the target pixel portion, the value of the fourth bit is "1." Note that regarding mask data for a pixel in which a plurality of types of objects overlap, the values of a plurality of bits are "1" depending on the types of the overlapping objects. For example, regarding mask data for a pixel in which text data and image data overlap, the value of the second bit and the value of the fourth bit are "1" as shown in FIG. 17. Using mask data such as that described above, regions are set at step S330 which will be described later.

After generating the mask data, the print control apparatus 310 receives printing data DA from the printing data generating apparatus 200 (step S320). Note that in the present embodiment, at this step S320, the print control apparatus 310 also receives the mask data from the printing data generating apparatus 200.

Then, based on the printing data DA obtained at step S320, for all pages included in the printing data DA, regions (a high-resolution estimation area R1 and a low-resolution estimation area R2) are set on a per object type basis, with reference to the mask data (step S330). In the present embodiment, a region having text data and a region having thin-line data are set as high-resolution estimation areas R1, and a region having tint or illustration data and a region having image data are set as low-resolution estimation areas R2. Note, however, that such setting is an example and the present invention is not limited thereto. As described above, as in the second embodiment, two regions (a high-resolution estimation area R1 and a low-resolution estimation area R2) are set without through a user operation.

Then, estimation using a high-resolution image is performed (step S340). Specifically, for the regions set as the high-resolution estimation areas R1 by the process at step S330 (i.e., the regions having text data or thin-line data), the amount of ink consumed is estimated using a high-resolution image created based on the printing data DA. As such, at step S340, the sum total of the amounts of ink for all pages that are required to print the regions having text data and the regions having thin-line data for the respective pages is calculated as a first amount of ink M1.

Then, estimation using a low-resolution image is performed (step S350). Specifically, for the regions set as the low-resolution estimation areas R2 by the process at step S330 (i.e., the regions having tint or illustration data, or image data), the amount of ink consumed is estimated using a low-resolution image created based on the printing data DA. As such, at step S350, the sum total of the amounts of ink for all pages that are required to print the regions having tint or illustration data and the regions having image data for the respective pages is calculated as a second amount of ink M2.

Finally, a total amount of ink Mall consumed by printing of the printing data DA is calculated based on the estimation result obtained at step S340 and the estimation result obtained at step S350 (step S360). Specifically, the total amount of ink Mall is calculated by the following equation:

$$\text{Mall}=M1+M2$$

where M1 represents the first amount of ink (the estimation value obtained at step S340) and M2 represents the second amount of ink (the estimation value obtained at step S350).

By calculating the total amount of ink Mall consumed by printing of the printing data DA in the above-described manner, the amount-of-ink-consumed estimation process ends.

Note that, in the present embodiment, a mask data generating step is implemented by the above-described step S310, a printing data obtaining step is implemented by the above-described step S320, a region setting step is implemented by the above-described step S330, a first estimating step is implemented by the above-described step S340, a second estimating step is implemented by the above-described step S350, and a total-amount-of-ink calculating step is implemented by the above-described step S360.

<3.3 Effects>

According to the present embodiment, a high-resolution estimation area R1 and a low-resolution estimation area R2 are set based on the type of object included in data of each pixel, without through a user operation. At that time, a region including an object that exerts a low degree of influence on estimation accuracy even if estimation is performed at a low resolution is set as a low-resolution estimation area R2, and a region including an object that exerts a great influence on estimation accuracy if estimation is performed at a low resolution is set as a high-resolution estimation area R1. Then, the amount of ink consumed in the region set as the high-resolution estimation area R1 is estimated using a high-resolution image created based on printing data DA, and the amount of ink consumed in the region set as the low-resolution estimation area R2 is estimated using a low-resolution image created based on the printing data DA. In this manner, the estimation value of the amount of ink consumed is calculated by combining estimation using a high-resolution image with estimation using a low-resolution image, while the characteristics of an image are considered. By the above, according to the present embodiment, an increase in the speed of an amount-of-ink-consumed estimation process is achieved while sufficient estimation accuracy is ensured, without placing an operational burden on the user.

<4. Others>

The above-described embodiments describe, as an example, the estimation of the amount of ink consumed in an inkjet printing apparatus that performs variable printing. However, the present invention is not limited thereto, and the present invention can also be applied to the estimation of the amount of ink consumed in an inkjet printing apparatus that does not perform variable printing.

Although two regions (a high-resolution estimation area R1 and a low-resolution estimation area R2) are set in a printing region in the above-described embodiments, the present invention is not limited thereto, and three or more regions may be set in a printing region. For example, three regions (a high-resolution estimation area, a middle-resolution estimation area, and a low-resolution estimation area) may be set in a printing region, and estimation for the regions may be performed using images with different resolutions. In this manner, a balance between processing speed and estimation accuracy can be achieved more suitably.

Although the present invention has been described in detail above, the above description is to be considered in all respects as illustrative and not restrictive. It will be understood that many other changes and modifications may be made without departing from the sprit and scope of the present invention.

Note that this application claims priority to Japanese Patent Application No. 2016-175150 titled "Method of Estimating Amount of Ink Consumed and Apparatus for Estimating Amount of Ink Consumed" filed Sep. 8, 2016, the content of which is incorporated herein by reference.

What is claimed is:

1. A method of estimating an amount of ink consumed when an inkjet printing apparatus performs printing, the method comprising:

a printing data obtaining step of obtaining printing data;

a region setting step of setting at least two regions in a printing region determined based on the printing data, the two regions including a first region and a second region;

a first estimating step of calculating a first amount of ink for each ink color, the first amount of ink being an amount of ink required to print a high-resolution image created based on the printing data and corresponding to the first region;

a second estimating step of calculating a second amount of ink for each ink color, the second amount of ink being an amount of ink required to print a low-resolution image created based on the printing data and corresponding to the second region; and a total-amount-of-ink calculating step of calculating, for each ink color, a total amount of ink consumed by printing of the printing data, from the first amount of ink and the second amount of ink, wherein in the printing data obtaining step, data generated by performing a rasterizing process on printing original data is obtained as the printing data, the printing original data including a plurality of types of objects, and in the region setting step, the first region and the second region are set based on a type of object included in data of each pixel.

2. The method of estimating an amount of ink consumed according to claim 1, further comprising a mask data generating step of generating mask data when the rasterizing process is performed on the printing original data to generate the printing data, the mask data representing correspondences between pixels and object types, wherein in the region setting step, the first region and the second region are set based on the mask data.

3. The method of estimating an amount of ink consumed according to claim 1, wherein in the region setting step, a region having data whose object type is text is set as the first region, and a region having data whose object type is an image is set as the second region.

4. An apparatus for estimating an amount of ink consumed when an inkjet printing apparatus performs printing, the apparatus comprising:

a printing data obtaining unit configured to obtain printing data for a plurality of pages;

a region setting unit configured to set, for each of the plurality of pages, at least two regions in a printing region determined based on the printing data, the two regions including a first region and a second region;

a first estimating unit configured to calculate a first amount of ink for each ink color, the first amount of ink being an amount of ink required to print a high-resolution image created based on the printing data and corresponding to the first region;

a second estimating unit configured to calculate a second amount of ink for each ink color, the second amount of ink being an amount of ink required to print a low-resolution image created based on the printing data and corresponding to the second region; and a total-amount-of-ink calculating unit configured to calculate, for each ink color, a total amount of ink consumed by printing of the printing data, from the first amount of ink and the second amount of ink, wherein the printing data obtaining unit obtains, as the printing data, data generated by performing a rasterizing process on printing original data including a plurality of types of objects, and the region setting unit sets the first region and the second region based on a type of object included in data of each pixel.

* * * * *